US006705959B2

(12) United States Patent
Morgan et al.

(10) Patent No.: US 6,705,959 B2
(45) Date of Patent: Mar. 16, 2004

(54) DIMPLE PATTERNS FOR GOLF BALLS

(75) Inventors: William E. Morgan, Barrington, RI (US); Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/078,417

(22) Filed: Feb. 21, 2002

(65) Prior Publication Data

US 2003/0158001 A1 Aug. 21, 2003

(51) Int. Cl.[7] ..... A63B 37/14
(52) U.S. Cl. ..... 473/383
(58) Field of Search ..... 473/378–384

(56) References Cited

U.S. PATENT DOCUMENTS

| | | | | |
|---|---|---|---|---|
| 4,389,365 A | | 6/1983 | Kudriavetz | 264/297.8 |
| 4,653,758 A | | 3/1987 | Solheim | 273/232 |
| 4,765,626 A | * | 8/1988 | Gobush | 473/383 |
| 5,249,804 A | * | 10/1993 | Sanchez | 473/379 |
| 5,688,193 A | | 11/1997 | Kasasima et al. | 473/379 |
| 6,520,873 B2 | * | 2/2003 | Inoue et al. | 473/378 |

OTHER PUBLICATIONS

Cromwell, Peter R., Polyhedra, Cambridge University Press 1997, pp. 54, 82, 83, and 88.

* cited by examiner

*Primary Examiner*—Mark S. Graham
*Assistant Examiner*—Raeann Gorden
(74) *Attorney, Agent, or Firm*—Swidler Berlin Shereff Friedman, LLP

(57) ABSTRACT

An improved dimple pattern for a golf ball is disclosed. The dimples may be arranged according to an Archimedean pattern. The dimples may be arranged on the golf ball such that there is no great circle about the golf ball that does not intersect a dimple. Preferred Archimedean patterns include a truncated octahedron, a great rhombcuboctahedron, a truncated dodecahedron, and a great rhombicosidodecahedron. A nonplanar parting line may be used. The parting line may include a parallel segment parallel to the true equator of the golf ball and a plurality of diverging segments that diverge and converge relative the true equator. The parallel segment may be non-collinear with the true equator. The diverging and converging parting line segments may cooperate to form areas that diverge and converge away from the true equator. The size of this area may be designed to not fully surround the biggest dimple or to minimize any undercut.

18 Claims, 5 Drawing Sheets

DIMPLE PATTERNS FOR GOLF BALLS

BACKGROUND OF THE INVENTION

1. Field of the Invention

The present invention generally relates to golf balls, and more particularly, to a golf ball having an improved dimple pattern.

2. Description of the Related Art

Golf balls generally include a spherical outer surface with a plurality of dimples formed therein. Conventional dimples are depressions that act to reduce drag and increase lift. These dimples are formed where a dimple wall slopes away from the outer surface of the ball, forming the depression.

Dimples typically have a circular cross sectional profile. However, dimple having profiles of other shapes are also possible. Such other profiles include parabolic curve, ellipse, semi-spherical curve, saucer-shaped curve, sine curve, truncated cone, flattened trapezoid, or the shape generated by revolving a catenary curve about its symmetrical axis. Other possible dimple designs include dimples within dimples and constant depth dimples.

Drag is the air resistance that acts on the golf ball in the direction opposite the ball's flight direction. As the ball travels through the air, the air that surrounds the ball has different velocities and, thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air below the ball. This pressure difference results in the overall force, called lift, which is exerted upwardly on the ball. For additional discussion regarding golf ball aerodynamics, see copending patent application No. 09/989,191 entitled "Golf Ball Dimples with a Catenary Curve Profile," filed on Nov. 21, 2001 and 09/418,003 entitled "Phyllotaxis-Based Dimple Patterns," filed on Oct. 14, 1999, both of which are incorporated herein in their entireties.

By using dimples to decrease drag and increase lift, golf ball flight distances have increased. In order to optimize ball performance, it is desirable to have a large number of dimples evenly distributed around the ball. In arranging the dimples, an attempt is made to minimize the space between dimples, because such space does not improve aerodynamic performance of the ball. However, since most golf ball dimples are formed using a two-piece mold, the two pieces being mated at a parting line, most golf balls have at least one great circle which corresponds to the parting line of the molds and upon which no dimples are formed.

Attempts at concealing golf ball parting lines using unusual molds have been made. One such design uses an icosahedral dimple arrangement. See U.S. Pat. No. 5,688,193, the disclosure of which is incorporated herein by reference. This design requires substantial undercuts to accommodate the icosahedral vertices. This is undesired because undercuts increase the difficulty of removing the ball from the mold. As the size of the undercuts increases, the difficulty of removing the ball from the mold increases. U.S. Pat. No. 4,653,758 discloses a golf ball design having a staggered parting line. In this design, the real parting line is only minimally displaced from the equator.

What is needed is an improved dimple pattern for which there is no great circle that does not intersect any dimples and that does not create an excessive amount of undercut.

SUMMARY OF THE INVENTION

The present invention is directed to a golf ball dimple pattern. According to one aspect of the invention, the dimples are arranged, at least in part, according to an Archimedean pattern. The dimples may be arranged on the golf ball according to an Archimedean pattern such that there is no great circle about the golf ball that does not intersect a dimple. Preferred Archimedean patterns include a truncated octahedron, a great rhombcuboctahedron, a truncated dodecahedron, and a great rhombicosidodecahedron.

According to another aspect of the invention, the golf ball has a nonplanar parting line. The parting line may include a parallel segment parallel to the true equator of the golf ball and a plurality of diverging segments that diverge and converge relative the true equator. The parallel segment may be non-collinear with the true equator. The dimples may be arranged on the golf ball such that there is no great circle about the golf ball that does not intersect a dimple. The diverging and converging parting line segments may cooperate to form areas that diverge and converge away from the true equator. The size of this area may be designed to not fully surround the biggest dimple or to minimize any undercut.

BRIEF DESCRIPTION OF THE DRAWINGS

The present invention is described with reference to the accompanying drawings, in which like reference characters reference like elements, and wherein.

DETAILED DESCRIPTION OF THE INVENTION

Figure 1:
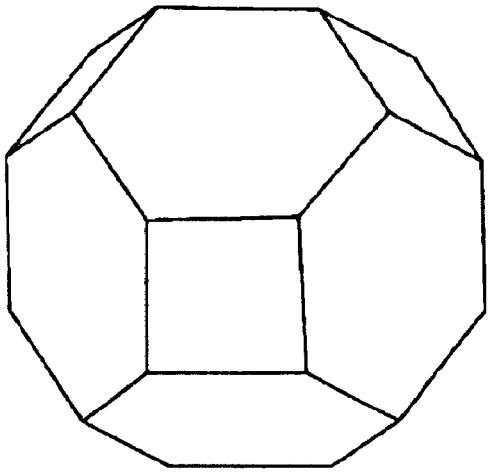
FIG. 1 shows a truncated octahedron.
Figure 2:
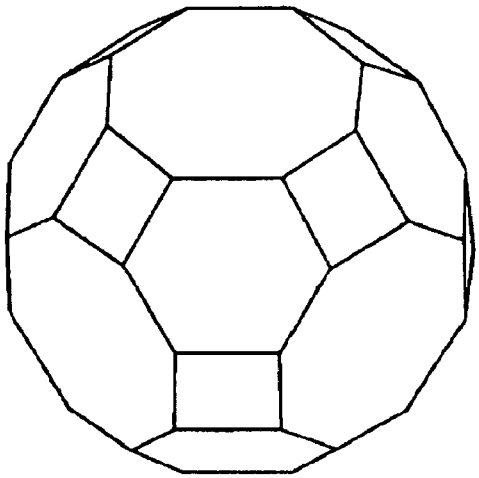
FIG. 2 shows a great rhombcuboctahedron.
Figure 3:
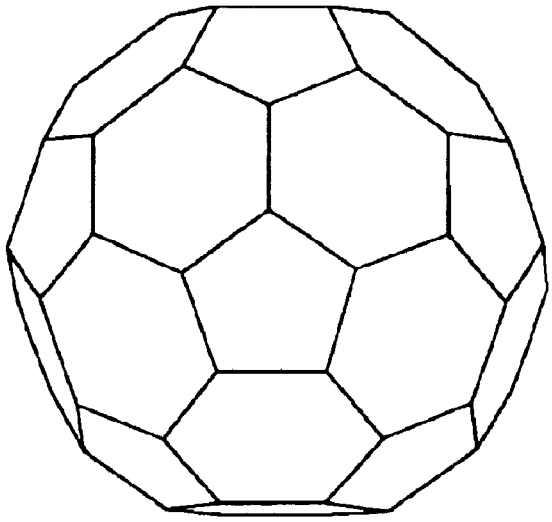
FIG. 3 shows a truncated icosahedron.
Figure 4:
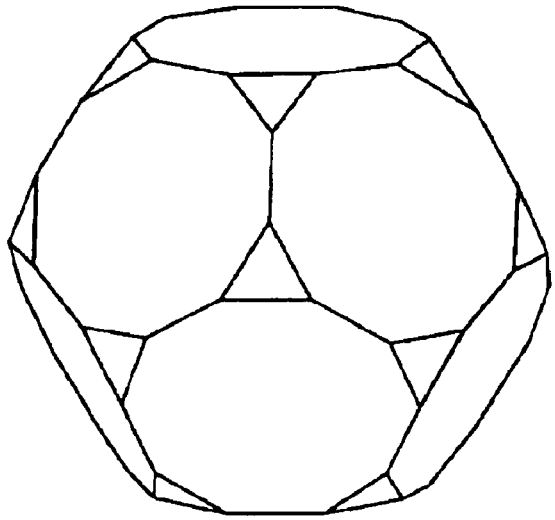
FIG. 4 shows a truncated dodecahedron.
Figure 5:
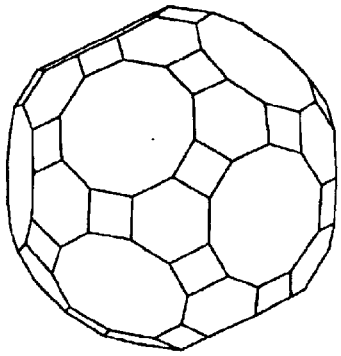
FIG. 5 shows a great rhombicosidodecahedron.

FIGS. 1–5 show Archimedean solids. An Archimedean solid is a semi-regular convex polyhedron with regular polygon faces. Semi-regular means that Archimedean solids have uniform vertices, but not uniform faces. FIG. 1 shows a truncated octahedron. The truncated octahedron has 14 faces and 28 vertices. FIG. 2 shows a great rhombcuboctahedron, also known as a rhombitrucated cubeoctahedron. The great rhombcuboctahedron has 26 faces and 48 vertices. FIG. 3 shows a truncated icosahedron. The truncated icosahedron has 32 faces and 60 vertices. FIG. 4 shows a truncated dodecahedron. The truncated dodecahedron has 32 faces and 60 vertices. FIG. 5 shows a great rhombicosidodecahedron, also known as a rhombitruncated icosidodecahedron. The great rhombicosidodecahedron has 122 faces and 120 vertices.

It has been found that arranging dimples on a golf ball in sub-regions or patterns can yield a compact dimple arrangement that maximizes the percentage of the golf ball surface area that contains dimples. Maximizing the percentage surface area that includes dimples is desirable due to the resulting improved aerodynamics.

Dimple patterns based on Archimedean solids, such as those shown in FIGS. 1–5, yield a compact dimple arrangement. Dimple patterns based on Archimedean solids also allow for a nonplanar parting line. One benefit of using Archimedean patterns in a mold with a nonplanar parting line is that it is possible to design dimple patterns where there is no great circle that does not intersect any dimples. It should be noted that patterns of other shapes are also available for use. The dimple pattern according to a great rhombicosidodecahedron will be discussed below for illustrative purposes only; the discussion below can be modified to apply with equal force to a dimple pattern of any desired shape or shape fragment.

Figure 6:
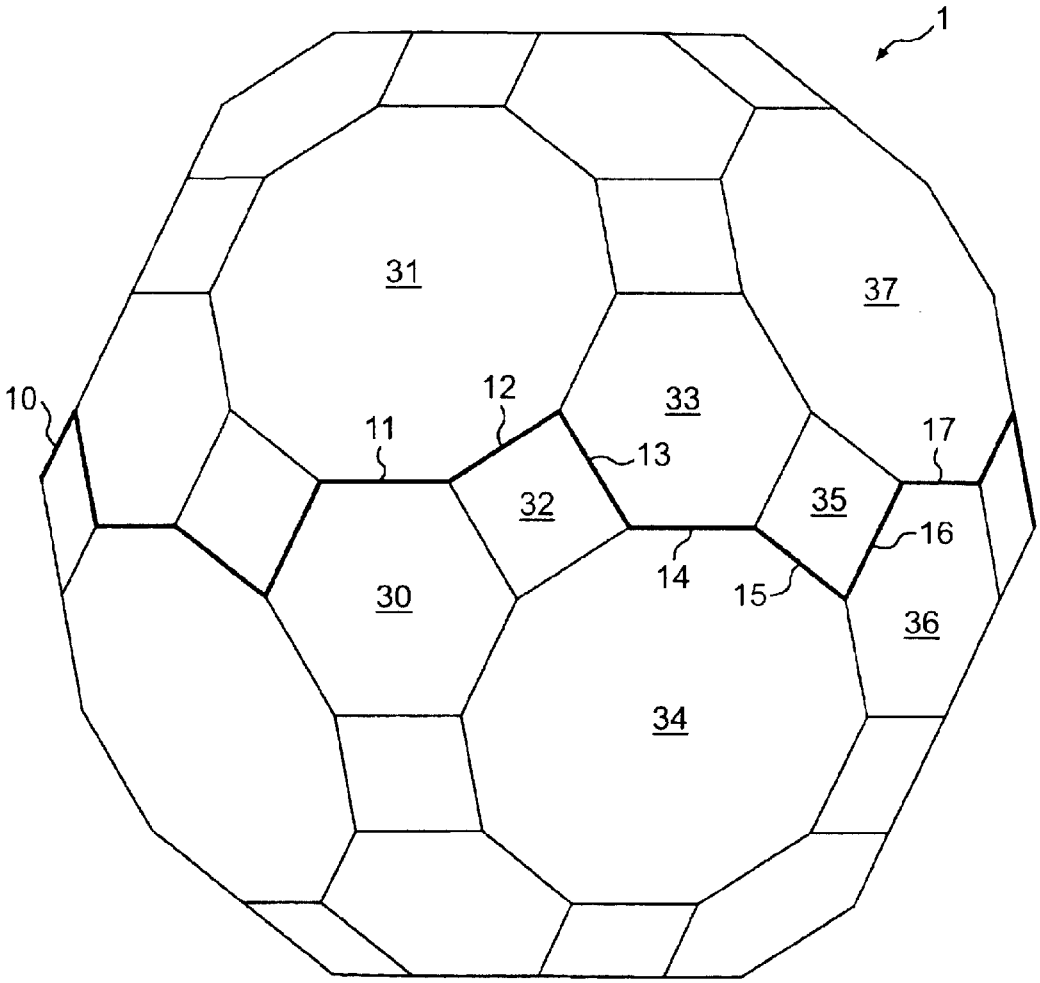
FIG. 6 shows a wire model of a great rhombicosidodecahedron.

FIG. 6 shows a wire model of a great rhombicosidodecahedron. To place dimples on a golf ball 1 according to a pattern defined by a great rhombicosidodecahedron, the surface of the ball is subdivided according to corresponding surfaces of the great rhombicosidodecahedron. The subdivisions are defined by a plurality of line segments. The parting line 10 of the mold is selected so that it travels along the edges where the adjoining surfaces meet Preferably, the parting line is selected so as to approximate (but not be) a great circle. As an example, the parting line 10 can follow a path that begins with a "flat" segment 11 defined by a side of a first hexagon 30 and a first decahedron 31. Parting line 10 diverges from flat segment 11 upward at inclined segment 12 between an adjacent second side of first decahedron 31 and a first side of a first square 32. Parting line 10 converges at inclined segment 13 downward between an adjacent second side of first square 32 and a first side of a second hexagon 33. Parting line 10 continues through a second flat segment 14 defined by an adjacent second side of second hexagon 33 and a first side of a second decahedron 34. Parting line 10 then diverges from flat segment 14 downwards at inclined segment 15 between an adjacent second side of second decahedron 34 and a first side of a second square 35. Parting line 10 converges at inclined segment 16 upwards between an adjacent second side of second square 35 and a first side of a third hexagon 36. Parting line 10 continues through a third flat segment 17 defined by an adjacent second side of third hexagon 36 and a first side of a third decahedron 37

Note that parting line 10 is described as "beginning" at flat segment 11 for ease of description only; the description could just as easily begin at any location along parting line 10. Likewise, the terms "flat," "inclined," "upwards," and "downwards" are used in the relative sense and for illustrative purposes only. Additionally, the parting line 10 can take a different path than that described above. No limitation should be implied by the use of these terms and descriptions.

This sequence of alternating "flat" segments is repeated with alternating divergences up and down until a complete circumference of the sphere has been completed. The "flat" segments are parallel to a true great circle, and on this particular pattern ten such segments exist. On this pattern, alternating flat segments are located slightly above and slightly below the "true equator" defined by a great circle that perfectly bisects the sphere. Other embodiments might have the flat segments coincide with the true equator or a different number of flat segments. Preferably, the flat segments are in the immediate vicinity and are parallel to the true equator.

In between these flat segments are staggered divergences from the true great circle. On this particular pattern, there are ten such divergences, alternating above and below the true parting line. Following the side of a square, the parting line both diverges and converges with the true great circle at an angle of about 45°. Thus, the true parting line of the mold will have ten regions where it is flat and ten regions where it is staggered. In this particular example, five, or half, of the staggered portions extend above the flat segments, five below. Other arrangements are also possible. In this particular example, each area enclosed by divergence from flat is fairly small and contains less than one dimple. Other possible embodiments could have a different number of divergences, define larger or smaller divergent areas, or contain more than one dimple.

As the parting line diverges from the true equator, the circumference of the mold cavity decreases, essentially creating an "undercut." As the undercuts become more pronounced, it may become more difficult to remove the molded parts. Excessive undercut also increases the likelihood of damaging the molded surface of the golf ball while removing the ball from the mold. The potential problems associated with a pronounced undercut also may become more significant as the number of dimples present in the divergent regions increases. U.S. Pat. No. 4,389,365 discloses a mold in which one of the two mold parts covers substantially more of the ball than does the other. This design requires a mechanical means to remove the ball from the mold. This design is not preferred, as the mechanical ball removal means may adversely affect the ball surface.

Figure 7:
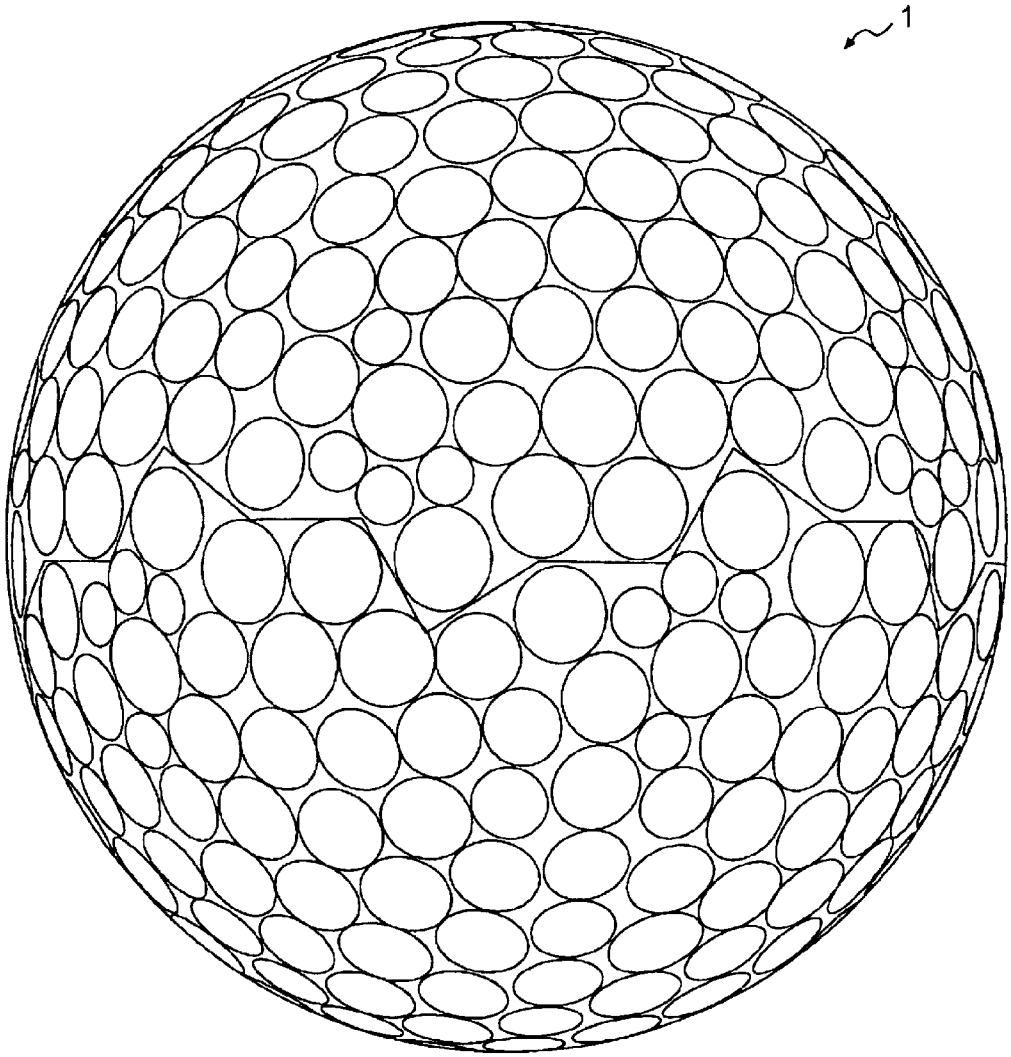
FIG. 7 shows a golf ball 1 with dimples arranged according to a great rhombicosidodecahedron pattern.

FIG. 7 shows a golf ball 1 with dimples arranged according to a great rhombicosidodecahedron pattern. In this particular example the great rhombicosidodecahedron has been filled with dimples to create a golf ball with 402 dimples of six different sizes. Using an alternate dimple arrangement, a different dimple count, or a different number of dimple sizes is also within the scope of this invention. All dimple arrangements that conform to the parting line staggering method are acceptable.

Figure 8:
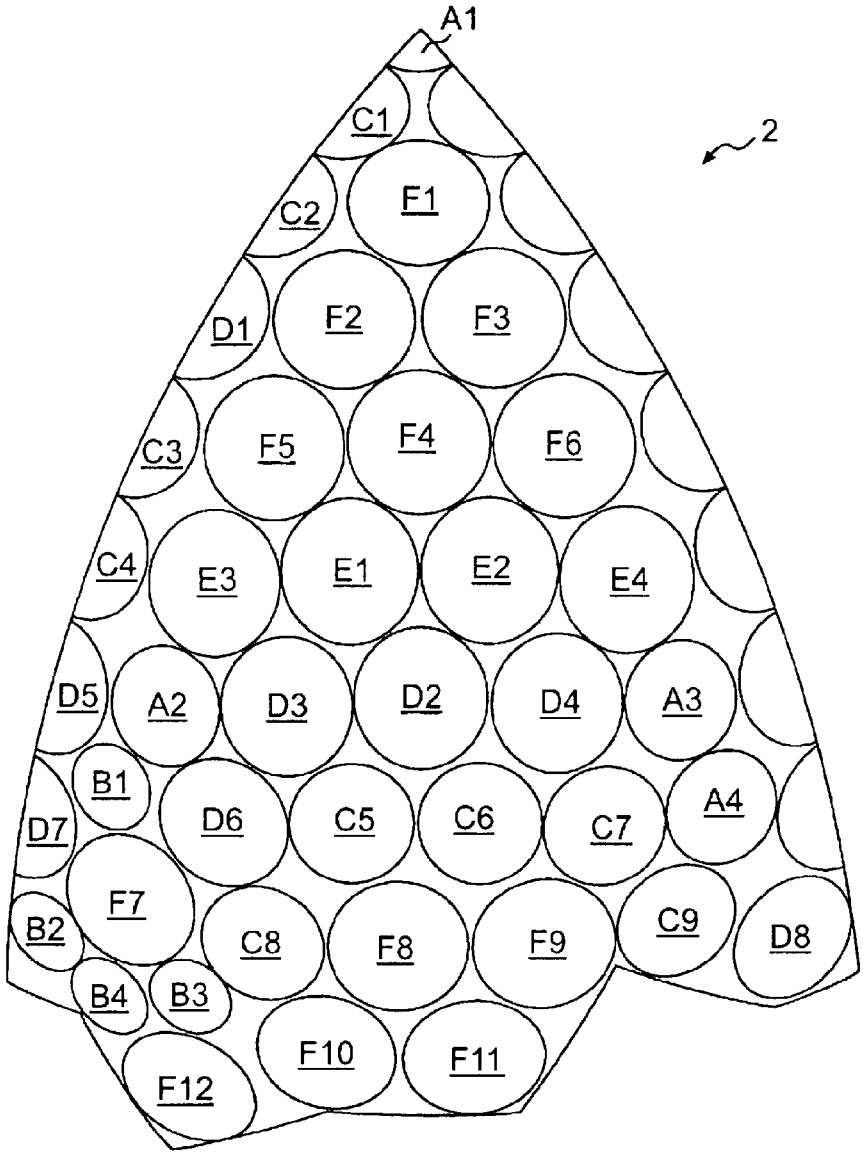
FIG. 8 shows a sector of the golf ball of FIG. 7.

With the great rhombicosidodecahedron example, the hemispheres can be subdivided into five equal sectors. FIG. 8 shows a sector 2 of the golf ball 1 of FIG. 7. Each sector 2 defines 40 dimples of six sizes. The dimples are labeled with letters A–F according to size. Dimple A1 is common to all five sectors. In this example, golf ball 1 contains 402 dimples.

As seen in FIG. 7, golf ball 1 may comprise an outer surface having dimples therein arranged according to an Archimedean pattern such that there is no great circle about the golf ball that does not intersect a dimple. The parting line is nonplanar, and corresponds to the mating of two molds. The parting line may comprise a series of lines diverging away from and converging towards an equator of the golf ball. Two adjacent segments, at least one of which intersects a true planar equator, cooperate to define a triangular region. This region may contain no more than one dimple, and may contain a portion of but not an entire dimple.

Figure 9:
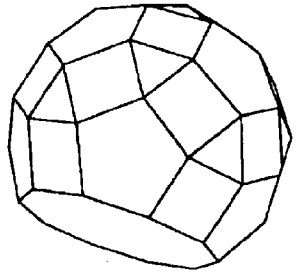
FIG. 9 shows a para diminished rhombicosidodecahedron.

Dimples may also be positioned on a golf ball according to portions or fragments of Archimedean solids. FIG. 9 shows a para diminished rhombicosidodecahedron, which is such a fragment. Preferably, the fragment is located at or about the parting line.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf ball comprising an outer surface having dimples therein, the dimples being arranged on the outer surface at least in part according to an Archimedean pattern and such that the surface is subdivided into two parts approximating hemispheres but not intersecting along a plane.

2. The golf ball of claim 1, wherein the dimples are arranged such that there is no great circle about the golf ball that does not intersect a dimple.

3. The golf ball of claim 1, wherein the Archimedean pattern is selected from the group consisting of a truncated octahedron, a great rhombcuboctahedron, a truncated dodecahedron, and a great rhombicosidodecahedron.

4. The golf ball of claim 1, further including a nonplanar parting line, the nonplanar parting line including first segments parallel to and spaced from a true planar equator and second segments angled to and crossing the true planar equator.

5. The golf ball of claim 1, wherein all of the dimples are arranged according to an Archimedean pattern.

6. The golf ball of claim 1, wherein at least a portion of the dimples are arranged according to a regular faced fragment of an Archimedean solid.

7. The golf ball of claim 6, wherein the fragment is at or about the parting line.

8. The golf ball of claim 1, further including a parting line, and wherein:

the outer surface is subdivided into a plurality of regions corresponding to faces of the Archimedean pattern;

each of the plurality of regions has a perimeter divided by edges; and the parting line is defined by a plurality of edges.

9. A golf ball comprising an outer surface having dimples therein and a nonplanar parting line, the parting line corresponding to the mating of two molds, the dimples being arranged according to an Archimedean pattern such that there is no great circle about the golf ball that does not intersect a dimple.

10. The golf ball of claim 9, wherein the parting line comprises a series of lines diverging away from and converging towards an equator of the golf ball.

11. The golf ball of claim 9 wherein:

the Archimedean pattern includes a subdivision of the outer surface, the subdivisions being defined by a plurality of line segments; and two adjacent segments, at least one of which intersects a true planar equator, cooperate to define a triangular region.

12. The golf ball of claim 11, wherein the region contains no more than one dimple.

13. The golf ball of claim 12, wherein the region contains a portion of but not an entire dimple.

14. A golf ball, comprising:

an outer surface containing dimples arranged at least in part according to an Archimedean pattern;

a true equator; and a nonplanar parting line, the parting line including one or more segments parallel to the true equator and a plurality of diverging segments that intersect the true equator.

15. The golf ball of claim 14, wherein the parallel segment is not collinear with the true equator.

16. The golf ball of claim 14, wherein the parallel segments include one or more parallel segments on one side of the true equator and one or more parallel segments on an opposite side of the true equator.

17. The golf ball of claim 16, wherein the parallel segments alternate above and below the true equator.

18. The golf ball of claim 14, wherein the dimples are arranged such that there is no great circle about the golf ball that does not intersect a dimple.

* * * * *